US005108314A

United States Patent [19]

Takano et al.

[11] Patent Number: 5,108,314

[45] Date of Patent: Apr. 28, 1992

[54] CONNECTOR ASSEMBLY FOR ELECTRICAL COMPONENTS

[75] Inventors: Tsunesuke Takano; Kouichi Sinzawa, both of Tokyo, Japan

[73] Assignee: Daiichi Denso Buhin Co., Ltd., Tokyo, Japan

[21] Appl. No.: 683,703

[22] Filed: Apr. 11, 1991

[30] Foreign Application Priority Data

Apr. 25, 1990 [JP] Japan ..... 2-44127[U]
Apr. 25, 1990 [JP] Japan ..... 2-44128[U]

[51] Int. Cl.[5] ..... H01R 13/68

[52] U.S. Cl. ..... 439/621; 439/557; 439/698

[58] Field of Search ..... 439/620-622, 439/698, 830, 586-595, 544, 549, 555, 557; 337/181-185, 214, 215, 198

[56] References Cited

U.S. PATENT DOCUMENTS 4,238,140 12/1980 Cairns ..... 439/709
4,560,227 12/1985 Bukala ..... 439/621
4,722,701 2/1988 Bradt ..... 439/621
4,778,965 10/1988 Valenzona ..... 439/554

FOREIGN PATENT DOCUMENTS 2511459 9/1976 Fed. Rep. of Germany ..... 439/622
50-36658 10/1975 Japan .

*Primary Examiner*—David L. Pirlot
*Attorney, Agent, or Firm*—Nixon & Vanderhye

[57] ABSTRACT

Connector assemblies for electrical components include a base frame having opposing side walls and opposed pairs of interior walls which are disposed parallel to the side walls. The interior walls define a mounting hole which is sized and configured to receive an individual one of the holders. The interior walls are interiorly spaced from their respective side walls so as to establish a relief slot therebetween. The side walls of the base frame are provided with vertically separated locking tabs and mounting flanges. During mounting of the connector assembly to the supporting structure, the locking tabs will be inwardly resiliently displaced until such time that they each clear the edge which defines the mounting space in the supporting structure for the connector assembly. At that time, the locking tabs will resiliently return to their "normal" condition. As a result, the supporting structure will be lockably positioned between the vertically separated locking tabs and mounting flanges.

4 Claims, 9 Drawing Sheets

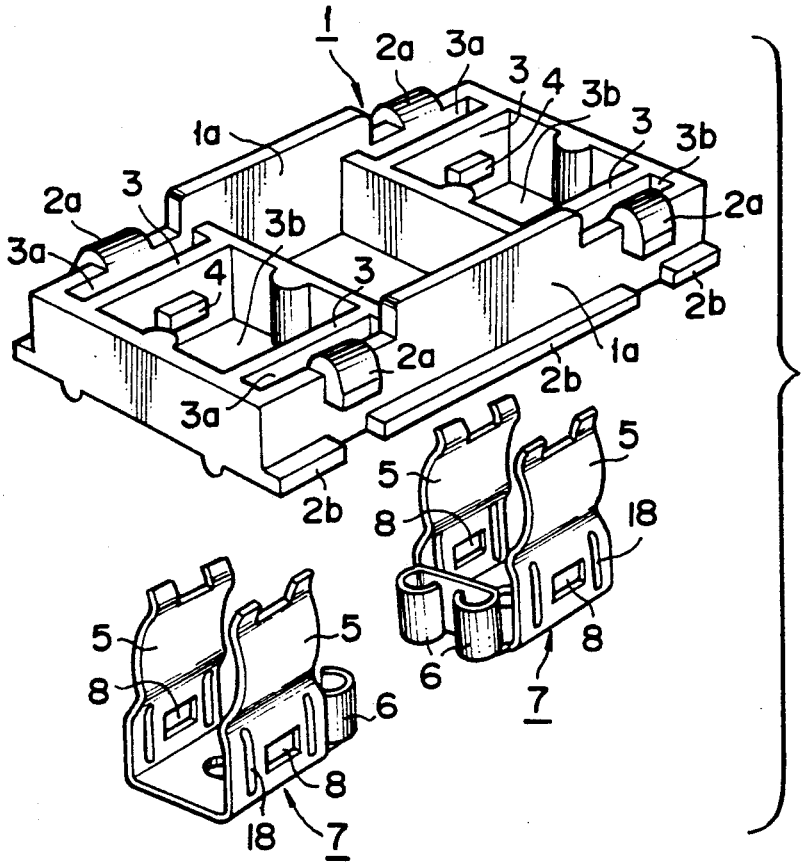
FIG. 1
FIG. 3
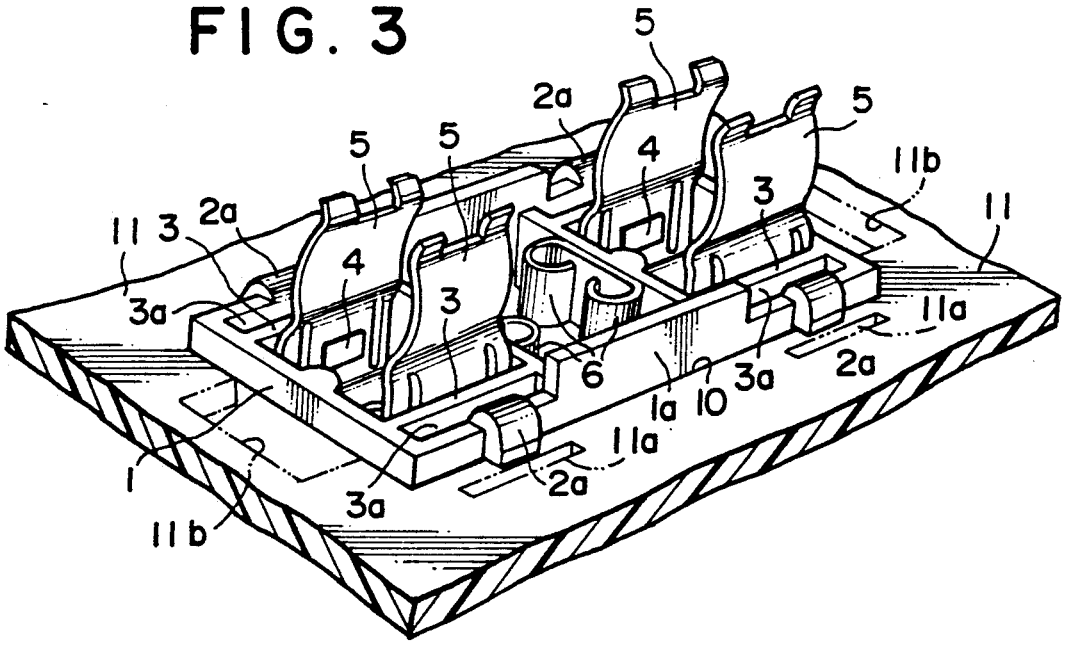

CONNECTOR ASSEMBLY FOR ELECTRICAL COMPONENTS

FIELD OF INVENTION

The present invention generally relates to an assembly by which electrical components may be attached physically to a support member. More specifically, the present invention relates to an assembly which includes a pair of electrical connectors that are adapted to hold an electrical component, for example, a straight-tube lamp, glass-tube fuse, and the like, and to establish electrical connection between the component an an external circuit, for example, by means of a tab terminal or the like.

BACKGROUND OF THE INVENTION

Japanese Examined Utility Model Publication No. 50-36658 discloses a conventional connector device adapted to holding straight glass-tube fuses. In this regard, the connector disclosed in Japanese Publication No. 50-36658 includes a fuse box base having pairs of U-shaped fuse holders formed from a resilient electrically conductive metal sheet. The fuse holders are fashioned so as to have inwardly tapered faces at the respective ends of the metal sheet which are arcuately shaped so as to be suitable for holding a respective end of a cylindrical glass-tube fuse.

The sides of the fuse holders are provided with elongate slots which register with projections formed on opposing sides of mounting holes formed in the fuse box base. The fuse holders are thus coupled to the fuse box base by means of the projections being inserted within a respective one of the slots. Each of the projections is, moreover, provided with a recessed groove which engages an edge associated with a respective one of the slots when the fuse holders are positioned within the fuse box base so as to prevent the fuse holder from becoming uncoupled. Thus, according to this prior art proposal, fuse holders are reliably coupled to a fuse box base, but can be easily exchanged when desired.

However, external electrically conducting members, such as lead wires, typically must be soldered to the fuse holders of the above-described prior art device when the fuse holders are to be coupled to an electrical circuit. Alternatively, a relatively narrow conducting strip (termed a "bus bar" in art parlance) must be caulked to the fuse holders in order to establish electrical connection. Thus, one disadvantage of the prior art device described above is that soldering and/or caulking tools are required in order to electrically connect the fuse holders to an electrical circuit. As a result, electrical connection is difficult (if not impossible) in dark or confined locations (e.g., the interior of an automobile's engine compartment).

In addition, in order to mount the fuse holders onto supporting structure which is itself electrically conductive, such as the body and chassis components of an automobile, it is necessary to place special insulating bushings between each of the holders and the electrically conductive support structure. As a result, installation of the holders becomes somewhat tedious and thus labor-intensive.

Moreover, since the contact members of the holders tend to generate heat during operation of the electrical components, the entire fuse box is typically required to made of a relatively expensive, heat-resistant plastics material, such as nylon-66.

Thus, what has been needed in this art is a connector assembly which allows external conducting members to more easily and reliably be coupled to the electrical component holders associated with the connector assembly without the need for special connecting tools. In addition, what has been needed is a connector assembly which can easily and reliably be connected to virtually any supporting structure without regard to the supporting structure's electrical conductivity so that the need for special insulating bushings and the like can be avoided. It is towards satisfying these needs that the present invention is directed.

SUMMARY OF THE INVENTION

The present invention is generally embodied in a connector assembly which includes an electrically insulating base frame having a pair of electrically conductive holders. The holders are spaced-apart from one another and are adapted to releasably mount an electrical component (e.g., a straight-tube fuse or lamp) to the base frame.

The base frame includes opposed pairs of interior walls which are disposed parallel to a respective one of the side walls of the base frame. The opposed pairs of interior walls thus define a mounting hole which is sized and configured to receive an individual one of the holders. The interior walls, moreover, are interiorly spaced from their respective side walls so as to establish a relief slot therebetween.

The side walls of the base frame are provided with vertically separated locking tabs and mounting flanges. During mounting of the connector assembly to the supporting structure, the locking tabs will be inwardly resiliently displaced until such time that they each clear the edge which defines the mounting space in the supporting structure for the connector assembly. At that time, the locking tabs will resiliently return to their "normal" condition. As a result, the supporting structure will be lockably positioned between the vertically separated locking tabs and mounting flanges.

Further aspects and advantages of this invention will become more clear after careful consideration is given to the following detailed description of the preferred exemplary embodiments thereof.

BRIEF DESCRIPTION OF THE ACCOMPANYING DRAWINGS

Reference will hereinafter be made to the accompanying drawings wherein like reference numerals throughout the various FIGURES denote like structural elements, and wherein;

FIG. 1 is a perspective view of one embodiment of a connector assembly according to the present invention showing the holders being separated from the base frame;

FIG. 3 is a perspective view showing the connector assembly of this invention mounted to the supporting structure;

DETAILED DESCRIPTION OF THE PREFERRED EXEMPLARY EMBODIMENTS

Figure 2:
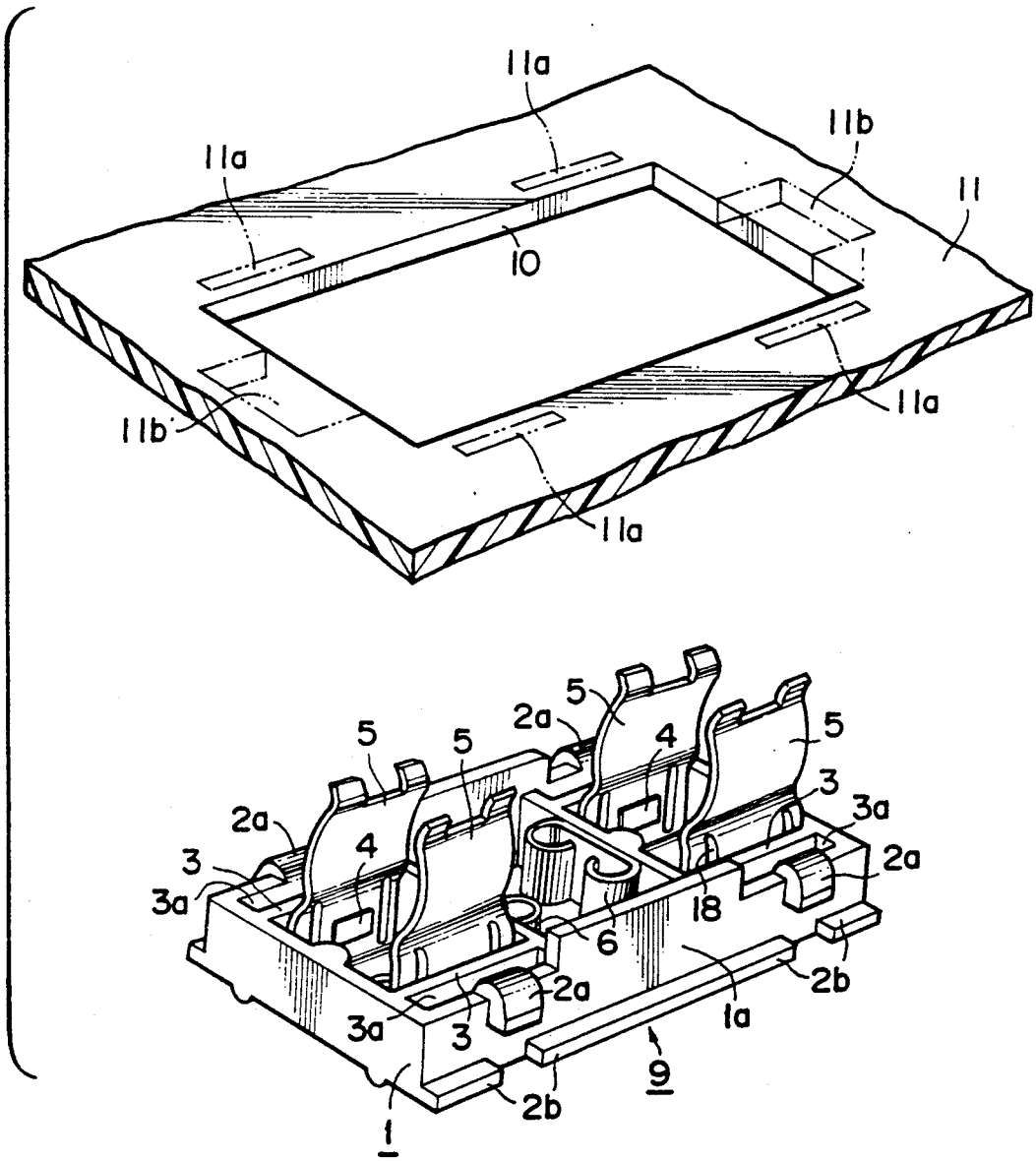
FIG. 2 is a perspective view whereby the connector assembly according to the present invention is shown separated from its supporting structure.
Figure 4:
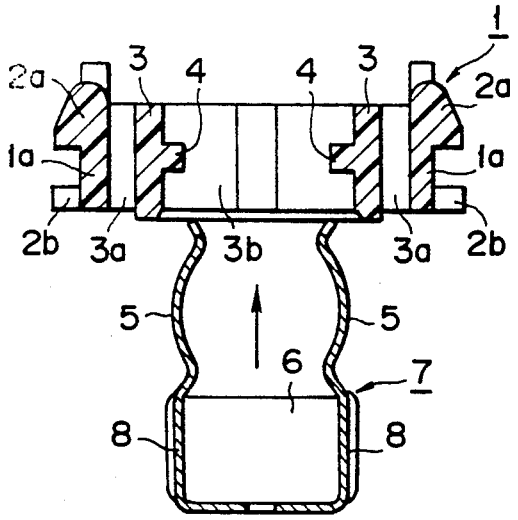
FIGS. 4–6 are each cross-sectional end elevation views respectively depicting the steps employed to mount the holders to the base frame.

One embodiment of a connector assembly according to the present invention is shown in accompanying FIGS. 1–3. As is seen the connector assembly generally includes an electrically insulating base frame 1 having an umber of locking tabs 2*a* and flanges 2*b* which project outwardly from the side walls 1*a* of the base frame 1. The base frame 1 is preferably formed from a heat-resistant plastics material so as to be generally in the form of a rectangular frame.

Opposed pairs of interior walls 3 are disposed parallel to a respective one of the side walls 1*a* and define therewith a mounting hole 3*b* which is sized and configured to receive an individual one of the holders 7. The interior walls are thus interiorly separated from the side walls 1*a* so as to define therebetween open-ended relief slots 3*a*. In addition, each of the interior walls 3 include an integral projection member 4 which extends into the interior space 3*b*.

The connector assembly of this invention thus includes a pair of holders 7, each of which is equipped as an integral unit with a pair of clamping pieces 5 formed from resilient metal strips into the shape of the letter "U" and a plug-in receptacle 6. The connectors 7 are most preferably formed of from an electrically conductive leaf spring material, such as phosphor bronze, nickel silver or beryllium copper, by being stamped from sheet stock of such material in the form of a cross-shaped strip. The strips are then bent into a generally U-shaped configuration by forming a bottom portion between the arms of the cross and bending the arms upwardly to form a pair of clamping pieces 5. The plug-in receptacles 6 may then be formed in a single plane by curling their respective strip portions inwardly and then bending them parallel to the pair of clamping pieces 5.

The connectors 7 are each mounted within the mounting holes 3*b* of the base frame 1 by virtue of the projections 4 being inserted within a respective one of the apertures 8 formed in the sides of the holders 7. The holders 7 also are provided with integral ribs 18 which serve to strengthen the clamping pieces 5 and maintain a separation distance between the holders 7 and the interior walls 3 to thereby provide a space through which heat generated during use may dissipate.

Figure 13:
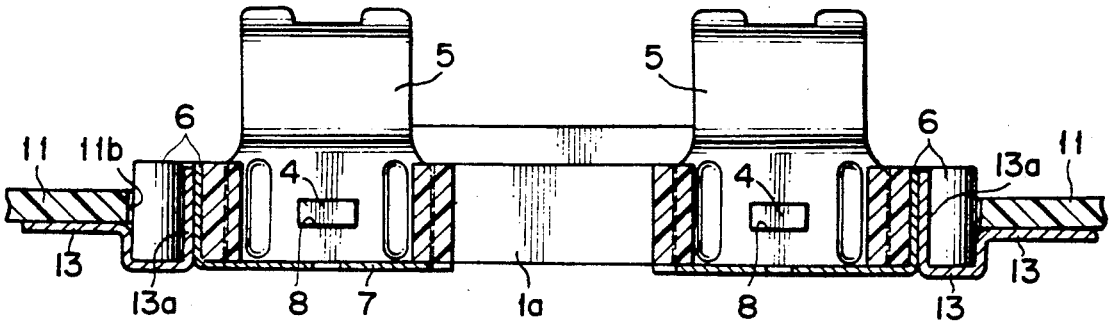
FIG. 13 is a cross-sectional side elevation view of a connector assembly showing an alternative manner in which a BUS bar may be coupled thereto.

The connector assembly may be mounted to support structure 11 as shown in FIG. 3. The support structure 11 may, for example, be electrically insulated as shown in the accompanying drawings but could likewise be electrically conductive since the base frame 1 is itself formed of an electrically insulating plastics material, such as, nylon-66 or polybutylene terephthalate. The support structure 11 includes a continuous edge 10 defining an open space which is sized and configured to accept therewithin the base frame 1 as shown in FIG. 3. Moreover, the supporting structure 11 may itself be provided with relief slots 11*a* positioned adjacent to a respective one of the locking tabs 2*a* to facilitate mounting of the base frame 1 thereto by providing a region of increased resiliency during assembly. The supporting structure may also include a cut-out portion 11*b* so as to accomodate a reverse arrangement of the plug-in receptacles 6 to that shown in FIGS. 1–3 (see in this regard, FIG. 13).

Figure 5:
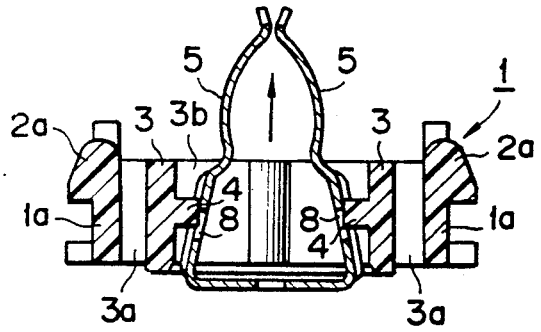
Figure 6:
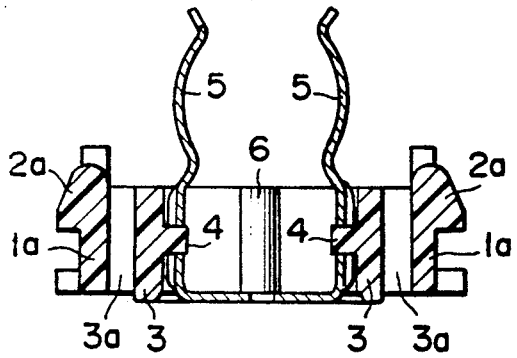
Figure 7:
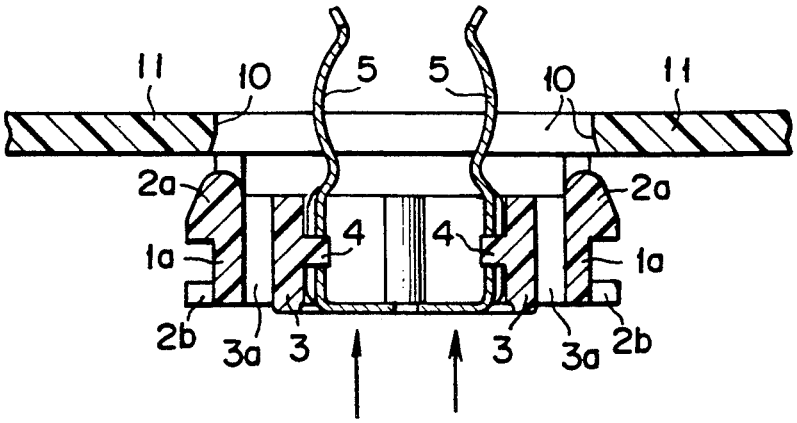
FIGS. 7–9 are each cross-sectional end elevation views respectively depicting the steps employed to mount the connector assembly of this invention to a supporting structure.

The manner in which the connector assembly according to this invention is manufactured and mounted to the support structure 11 is shown in accompanying FIGS. 4–10. As is seen particularly with respect to FIGS. 4–6, the individual holders 7 are inserted upwardly through the bottom of a respective one of the mounting holes 3*b*. During insertion of the holders 7, the clamping pieces 5 will be resiliently displaced towards one another as shown in FIG. 5 due to the presence of projections 4 on the interior walls 3. However, as soon as the projections 4 are in registry with the apertures 8, the clamping pieces 5 will resiliently expand to their "normal" condition thereby coupling the holders 7 to the base frame 1 within a respective one of the mounting holes 3*b*.

Figure 8:
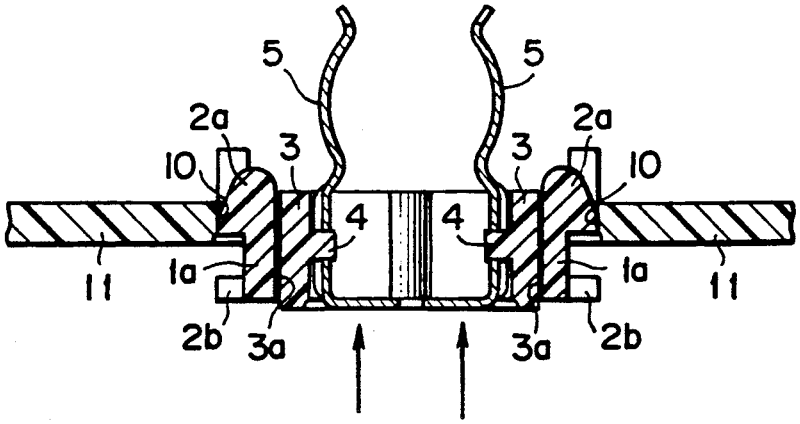

The thus formed connector assembly—i.e., having both holders 7 coupled to the base frame 1—may then be mounted to the support structure 11. This sequence is shown specifically in accompanying FIGS. 7–9. It will be observed, for example in FIG. 7, that the entire connector assembly is inserted from the bottom of the supporting structure 11. It will also be observed that the locking tabs 2*a* are formed with a sloped exterior surface. Thus, as the locking tabs 2*a* come into contact with the edge 10 of the support structure 11, the locking tabs 2*a* will be inwardly resiliently displaced as shown in FIG. 8. This inward displacement is, moreover, allowed due to the open-ended relief slots 3*a* defined between the side walls 1*a* and the interior walls 3 of the base frame 1.

Figure 9:
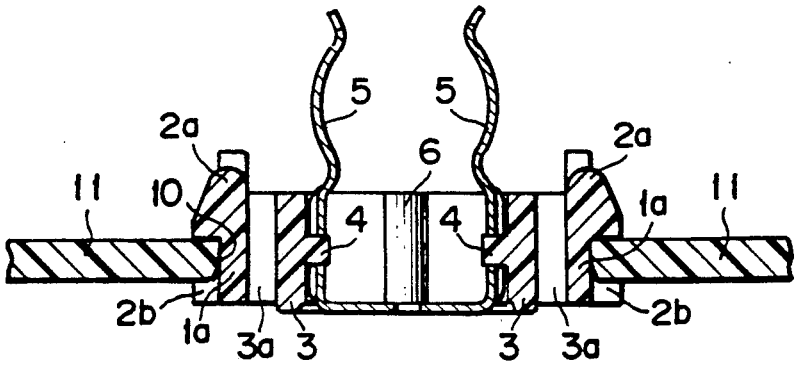

Once the locking tab 2*a* has cleared the edge 10, it will resiliently return to its "normal" state as shown in FIG. 9 to thereby provide a so-called "cassette locking mechanism" as a result of its clicking into place. The mounting flanges 2*b* thus prevent the base frame 1 from being pushed entirely through the space defined by the edge 10. Thus, the locking tabs 2*a* and mounting flanges 2*b* are vertically separated from one another by a dimension which accommodates the thickness of the supporting structure 11. That is, once the the locking tabs 2*a* clear the edge 10, the side wall la will resiliently return to its original condition so that the locking tab 2*a* and the mounting flange associated with the side wall 1*a* will securely lock the connector assembly to the supporting structure 11. Thus, vertical movement of the connector assembly is restricted collectively by means of the locking tabs 2*a* and mounting flanges 2*b*. And horizontal movement of the connector assembly is restricted due to the edge 10 of the supporting structure 11 closely conforming to the periphery of the base frame 1.

Figure 10:
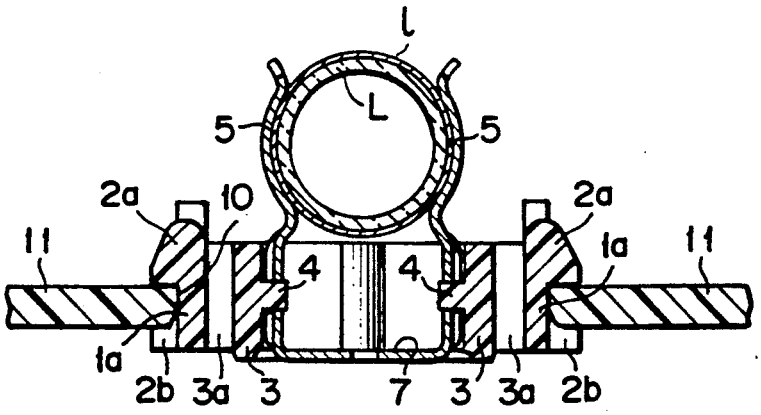
FIG. 10 is a cross-sectional end elevation view showing a straight-tube lamp mounted to the holder.

Once the connector assembly has been mounted to the supporting structure, an electrical component, for example, a straight-tube lamp L may be clamped between the holders 7 by inserting the lamp's cylindrical terminals l between the clamping pieces 5 of each holder as shown in FIG. 10.

Figure 11:
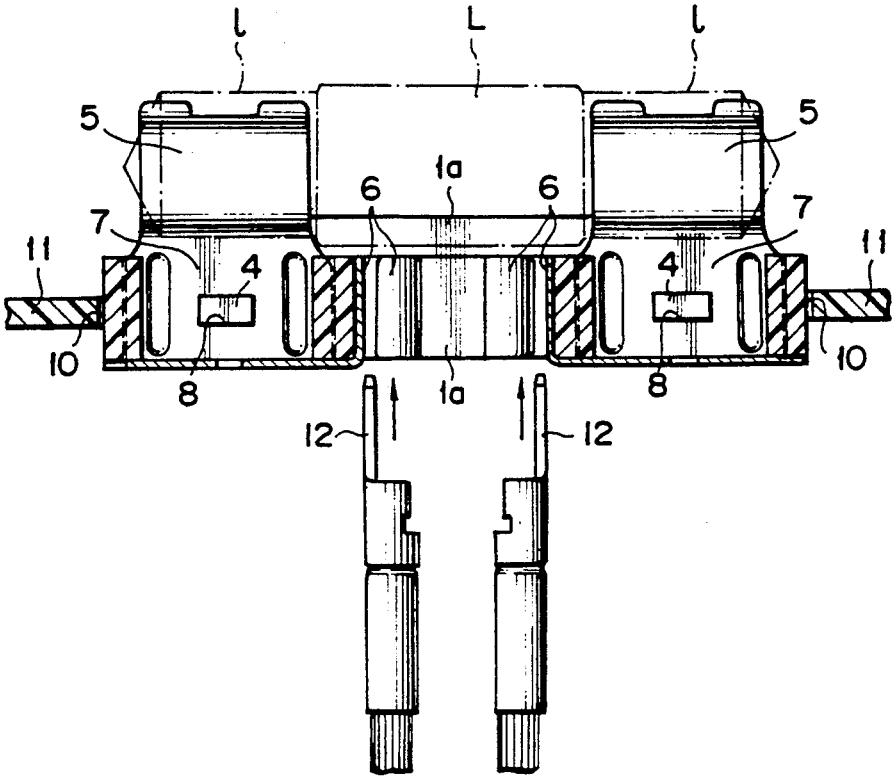
FIG. 11 is a cross-sectional side elevation view of a connector assembly according to the present invention showing the manner in which connector tabs associated with lead wires may be coupled thereto.
Figure 12:
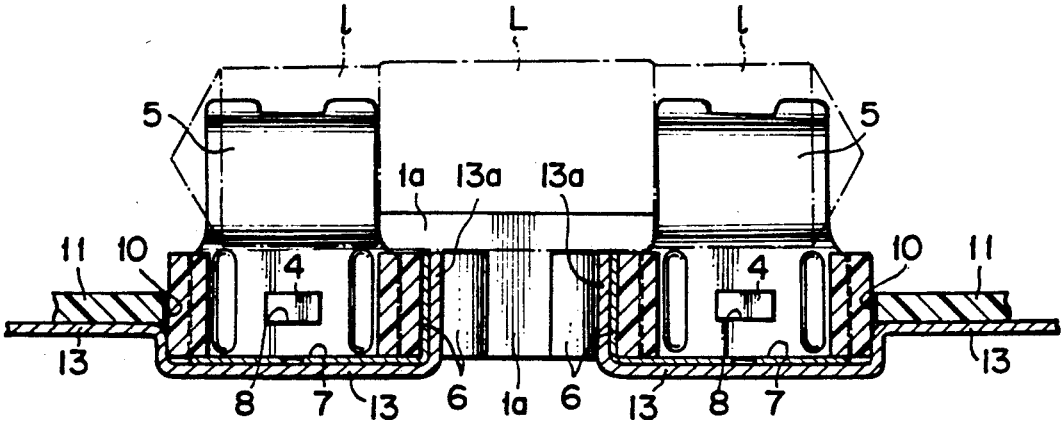
FIG. 12 is a cross-sectional side elevation view of a connector assembly according to the present invention showing the manner in which a BUS bar may be coupled thereto.

The lamp L may be connected to an electrical circuit in a variety of ways as shown in FIGS. 11 and 12. For example, as shown in FIG. 11, electrical connection may be made by simply inserting tab terminals 12 into frictional engagement with a respective one of the plug-in receptacles 6. Alternatively, electrical connection can be made by frictionally inserting a vertical segment 13*a* associated with a BUS bar 13 into a respective one of the plug-in receptacles 6 as shown in FIG. 12.

Figure 14:
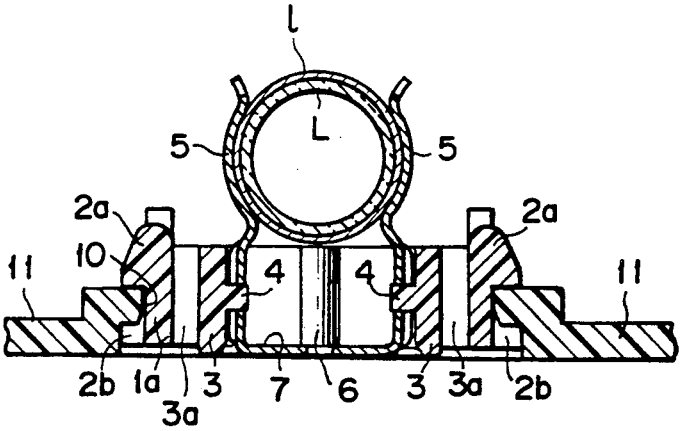
FIG. 14 is a cross-sectional end elevation view showing another possible support structure to which the connector assembly of this invention may be coupled.

Accompanying FIG. 14 shows an alternative arrangement for the support structure 11. IN this regard, that portion of the support structure 11 which includes the edge 10 is in the form of a raised platform so as to accomodate the mounting flange 2*b*. In this manner, the bottom of the base frame 1 can be positioned in a flush relationship to the support structure 11.

Figure 15:
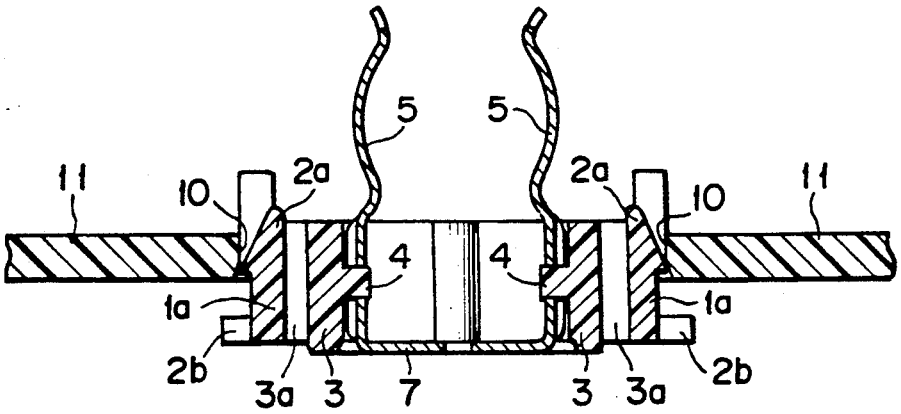
FIGS. 15–16 are each end elevation views showing the steps employed to couple another embodiment of a connector assembly according to this invention to a supporting structure.
Figure 16:
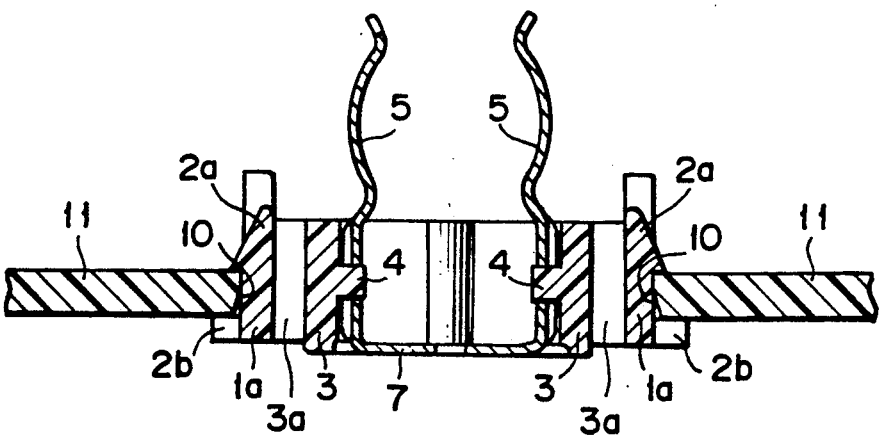

FIGS. 15-16 show an alternative embodiment which in all material respects is identical to the embodiments discussed above in relation to FIGURES 1-3, with the principal exception being that the extent of the outward projection of locking tabs 2*a* has been reduced. Thus, the mounting of the connector assembly embodiment shown in FIGS. 15-16 to the support structure 11 is more easily facilitated due to the reduced outward projection of the locking tabs 2*a*.

Figure 17:
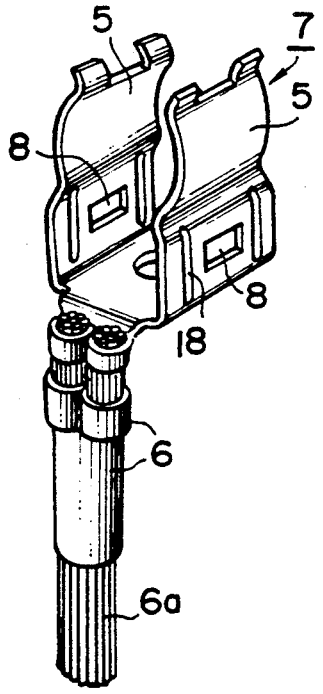
FIG. 17 is a perspective view of a holder which is adapted to be coupled directly to a lead wire.
Figure 18:
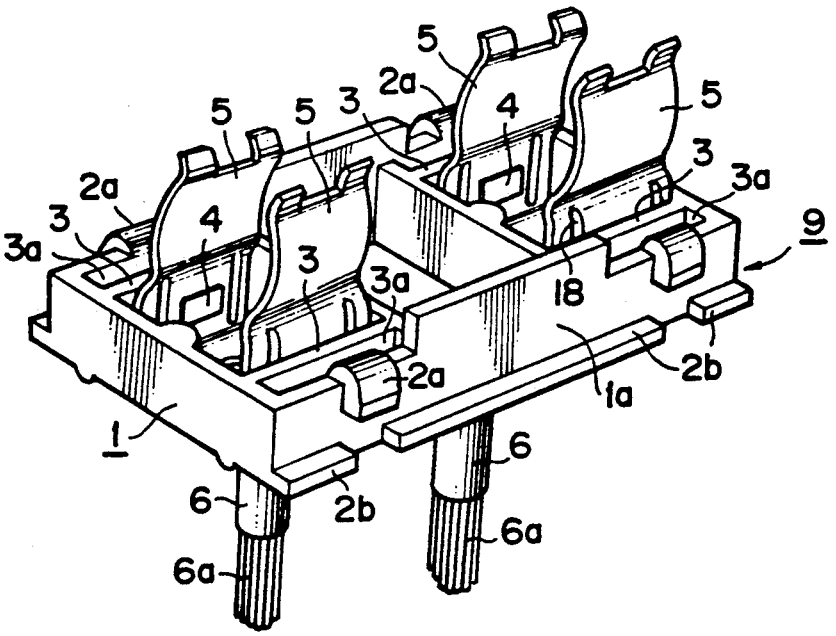
FIG. 18 is a perspective view of a connector assembly according to the present invention in which a pair of holders shown in FIG. 17 are employed.

Although the plug-in receptacles 6 associated with the holders 7 are especially adapted to accomodate either a connector tab (see FIG. 11) or a segment of a BUS bar (see FIG. 12), they may be directly coupled to a lead wire 6*a* as shown in FIG. 17 so that the holders 7 may then be mounted to the base frame 1 as shown in FIG. 18.

What is claimed is:

1. A connector assembly for mounting electrical components to a support structure, the support structure having a continuous edge which defines a mounting space which is sized and configured to accept the connector assembly therewithin, said connector assembly comprising:

a base frame formed of an electrically insulating material;

a pair of electrically conductive holders connected to the base frame for holding an electrical component therebetween and for establishing electrical connection between the electrical component and an external electrical circuit; wherein said base frame includes;

(a) a pair of side walls; and (b) opposed pairs of interior walls disposed parallel to respective ones of said side walls;

(c) each said side wall including vertically separated locking tabs and mounting flanges between which the edge of the support structure is disposed when said connector assembly is mounted thereto;

(d) said interior walls also being separated from said respective ones of said side walls adjacent to said locking tabs so as to establish therebetween open-ended relief slots, said relief slots allowing said side walls adjacent to said locking tabs to be inwardly resiliently displaced to permit said locking tabs to clear the edge of the supporting structure when said connector assembly is inserted into the defined mounting space, at which time the locking tabs move resiliently outwardly so that the edge of the supporting structure is disposed between said locking tabs and said mounting flanges, whereby said connector assembly is mounted to the supporting structure.

2. A connector assembly as in claim 1, wherein said holders include integral ribs for rigidifying said holder and for establishing a channel with an adjacent one of said interior walls to allow dissipation of heat.

3. A connector assembly as in claim 1, wherein said opposed pairs of interior walls including mounting projections, and wherein said holders include mounting apertures in which said mounting projections are inserted so as to mount said holders to said base frame.

4. A connector assembly as in claim 1, wherein said holders integrally include a plug-in receptacle for electrically connecting the holder to the external electrical circuit.

* * * * *